United States Patent [19]

Zabelka

[11] 4,395,268

[45] Jul. 26, 1983

[54] HOT GAS COOLER FOR A COAL GASIFICATION PLANT

[76] Inventor: Jaroslav Zabelka, Winterthur, Switzerland

[21] Appl. No.: 303,571

[22] Filed: Sep. 18, 1981

[30] Foreign Application Priority Data

Sep. 19, 1980 [CH] Switzerland ..... 7051/80

[51] Int. Cl.[3] ..... C10J 3/84; C10J 3/86

[52] U.S. Cl. ..... 48/67; 48/77; 55/269; 122/5; 122/6 A; 122/7 R; 122/235 A; 122/235 N; 122/235 K

[58] Field of Search ..... 48/67, 77, 63, 64; 122/5, 6 A, 7 R, 235 A, 235 N, 235 K; 55/269

[56] References Cited

U.S. PATENT DOCUMENTS

| | | | |
|---|---|---|---|
| 1,722,496 | 7/1929 | Chapman | 122/5 |
| 3,530,835 | 9/1970 | Von Wiesenthal | 122/6 A |
| 3,814,062 | 6/1974 | Vollhardt | 122/6 A |
| 4,272,255 | 6/1981 | Coates | 48/63 |
| 4,310,333 | 1/1982 | Schmidt et al. | 48/77 |
| 4,314,826 | 2/1982 | Vollhardt | 48/77 |
| 4,328,007 | 5/1982 | Rafael | 48/77 |

*Primary Examiner*—Peter F. Kratz
*Attorney, Agent, or Firm*—Kenyon & Kenyon

[57] ABSTRACT

The hot gas cooler comprises a vertical cylindrical pressure vessel and, disposed axially thereof, an insert which is closed over its periphery and embodied by sealingly welded-together tubes. The tubes are part of the heated pressure system of a vapor generator. The chamber bounded by the insert communicates at the top, by way of a gas supply passage extending through the pressure vessel with a reaction chamber and at the bottom, by way of a discharge passage, with a slag removal facility. Extending around the insert is a jacket embodied by sealingly welded-together tubes, so that an annular chamber closed off from the casing of the pressure vessel extends around the insert. The annular chamber communicates at the bottom with the insert chamber. Disposed in the top part of annular chamber is a coolable gas discharge passage which is connected to the jacket and extends through the pressure vessel.

6 Claims, 2 Drawing Figures

HOT GAS COOLER FOR A COAL GASIFICATION PLANT

Figure 1:
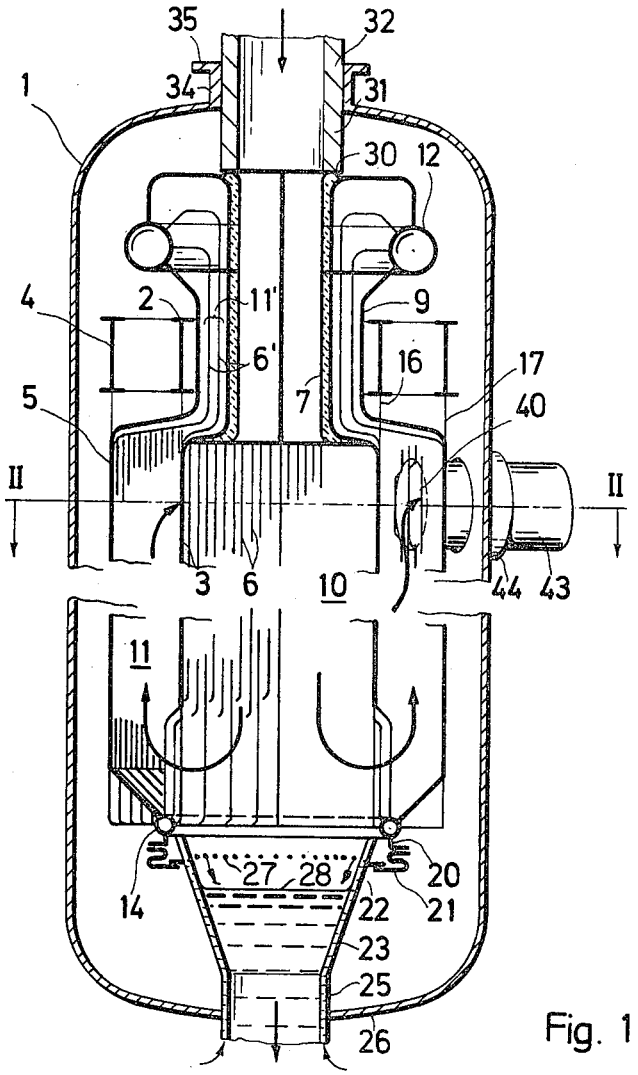

This invention relates to a hot gas cooler for a coal gasification plant.

As is known, coal gasification plants have been provided with coolers for cooling a flow of hot gas emanating from a reaction chamber. Generally, these coolers serve to cool the hot gas to a temperature of approximately 400° C. The resulting high temperature range on the gas side has thus required a correspondingly large heat transfer surface, i.e. an insert of appropriately large dimensions. As a result, the overall construction of the gas cooler has been relatively large.

Accordingly, it is an object of the invention to provide a hot gas cooler of relatively compact construction.

It is another object of the invention to provide a hot gas cooler of compact construction which can be readily serviced.

Briefly, the invention provides a hot gas cooler for a coal gasification plant which is comprised of a pressure vessel having a vertically disposed casing, an insert forming a fall chamber within the vessel, a jacket spaced about the insert to define an annular chamber and at least one gas exhaust passage communicating an upper end of the annular chamber with the exterior of the casing for exhausting cooled gas therethrough.

The insert is formed of a plurality of pipes which conduct medium therethrough and which are in secured relation to each other in order to define a fall chamber for conducting a hot gas therethrough. This insert has an inlet to the fall chamber at an upper end in order to receive a hot flow of gas for example from a reaction chamber of a coal gasification plant. In addition, the insert has an outlet from the fall chamber at a lower end in order to discharge slag particles, as well as a plurality of peripherally disposed openings for exhausting the hot gas flow from the fall chamber.

The jacket is likewise constructed of a plurality of pipes which conduct a cooling medium therethrough. In addition, the annular chamber defined, in part, by the jacket communicates with the peripheral openings in the insert and is sealed from the casing of the pressure vessel.

The construction of the cooler is such that the dimensions of the insert and, therefore, the pressure vessel, are small without making the insert inexcessible for servicing purposes.

The provision of the jacket constructed of, for example, sealingly welded-together pipes results in a second annular gas flue bounded on the inside by the insert. As a result, the outside of the insert is used for heat exchange so that the dimensions of the pressure system to be received in the pressure vessel can be reduced.

A particular advantage of the cooler is that for a given insert length, the diameter of the insert need not be overly increased in order to provide the necessary heat exchanger surface. Of note, overly increasing the diameter of the insert would lead to an excessive reduction in the speed of the gas column to be cooled. This, in turn, might lead to a one-sided flow profile resulting in poor utilization of the heat exchanger surface. in such a case, either the required cooling would not be provided or the insert and the pressure vessel would have to be further increased in size.

The insert and jacket are each shaped to substantially resemble an elongated prism of polygonal cross-section of regular n-sided cross-section. In this case, the insert and jacket can be formed by tube panels which can be readily produced in a workshop, conveyed and welded together in situ.

Where the insert and jacket are of polygonal cross-sectional shape, each is circumferentially offset from the other by an angle of 360°/2n. The advantage provided by this construction is that the annular gap between the insert and the jacket has uniformly distributed widened parts on the periphery. This facilitates inspection of the annular chamber for servicing and repair.

Of note, the insert may define a part of a heated pressure system of a vapor generator. Further, the pipes of the insert and jacket may be connected in parallel between a common distributor and a common collector.

Further, any suitable means for discharging slag from the outlet of the insert may also be provided within the cooler.

Figure 2:
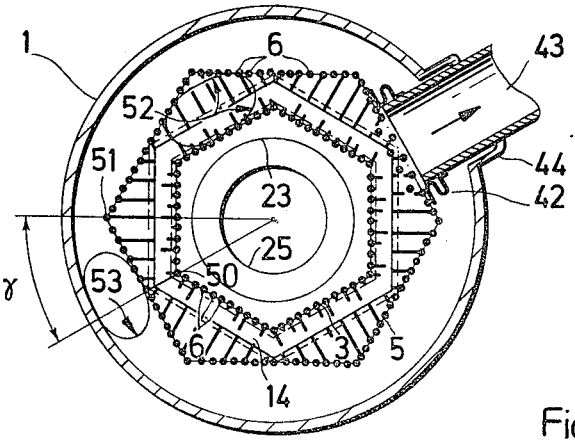

These and other objects and advantages of the invention will become more apparent from the following detailed description taken in conjunction with the accompanying drawings wherein:

FIG. 1 illustrates a vertical cross-sectional view of a hot gas cooler according to the invention; and FIG. 2 illustrates a view taken on line II—II of FIG. 1.

Referring to FIG. 1, the hot gas cooler is constructed for use with a coal gasification plant. The cooler includes a cylindrical pressure vessel 1 having a vertically disposed casing. In addition, the vessel 1 houses an inner ring 2 of beams from which an insert 3 is suspended as well as an outer ring 4 of beams from which a jacket or shell 5 is suspended.

Each of the insert 3 and the jacket 5 is embodied by a plurality of vertical pipes or tubes 6 for conducting a cooling medium therethrough which pipes are welded together in seal tight manner via webs. As indicated in FIG. 2, the insert 3 and jacket 5 are each shaped to substantially resemble an elongated prism of polygonal cross-section of regular n-sided cross-section, for example, of hexagonal cross-section.

As shown in FIG. 1, the pipes 6 of both the insert 3 and the jacket 5 are bent inwards at the upper end and some of the pipes 6 of the insert 3 welded together in seal tight manner to form a hexagonal cross-section neck 7. Some of the pipes 6 of the jacket 5 are also connected in similar fashion to form a neck 9. The remaining pipes 6' of the insert 3 and jacket 5 extend in an annular gap 11' between the two necks 7, 9 and the ends of all the pipes 6 and 6' are welded into a hexagonal ring collector or main 12.

As shown, the pipes 6 of the insert 3 and jacket 5 are connected in parallel between the common collector 12 and a common distributor 14. This distributor 14 is located at the bottom ends of the insert 3 and jacket 5 and is of hexagonal contour.

The pipes 6 of the insert 3 define a fall chamber 10 for conducting a hot gas therethrough. The insert 3 has an inlet defined by the neck 7 to the fall chamber 10 at an upper end in order to receive a flow of gas, for example from a reaction chamber of a coal gasification plant (not shown). In addition, the insert 3 has an outlet from the fall chamber 10 at a lower end in order to discharge slag particles as well as a plurality of peripherally disposed openings in order to exhaust the hot gas from the fall chamber 10. As indicated in FIG. 1, in the terminal region, the pipes of the insert 3 are so bent out alternately that an open tube bunch arises to form the peripherally disposed openings.

The jacket 5 is spaced about the insert 3 in order to define an annular chamber or gap 11 which communicates via the peripheral openings with the central fall chamber 10. The annular chamber 11 is sealed from the casing of the vessel 1 by the jacket 5.

As indicated in FIG. 1, the pipes of the jacket 5 cooperate with the webs of the jacket 5 to form a sealed-tight wall which extends as far as the distributor 14. However, approximately half the pipes are bent out of the wall in the bottom zone and extend, in conventional manner, into the distributor 14 at an offset from the wall forming pipes in order not to weaken the distributor 14 excessively.

A ring 20 is disposed at the bottom of the distributor 14 and is secured to a bellows 21 which provides a seal tight communication with a flange 22 of a double-walled funnel 23. As shown, the funnel 23 is coaxial with the fall chamber 10 and serves as part of a means for discharging slag from the outlet of the insert 3.

The funnel 23 has a neck 25 which extends downwardly through a base 26 of the pressure vessel 1. In addition, the space between the two walls of the funnel 23 is filled with cooling water which issues through orifices 27 to form a level of water 28 within the funnel 23.

The neck 7 of the insert 3 communicates at the top via a resilient element (not shown) with an inwardly projecting edge 30 of a pipe 31 which has a lining of insulating bricks 32 and forms the exit of a reaction vessel (not shown). The lining 32 passes through a stub pipe or inlet spigot 34 which is secured to the pressure vessel 1 at the upper end in pressure-tight manner and which carries a flange 35.

The jacket 5 is also provided with an orifice 40 near the upper end below the neck 9 near which some of the pipes are bent out from the plane of the jacket surface and to which no connecting webs are secured. The edge of the aperture 40 on the outside of the jacket 5 is connected via a bellows 42 with a discharge line or passage 43 which extends out of the pressure vessel 1 via a resilient sleeve 44 (see FIG. 2).

The tubes 6 which are in parallel between the distributor 14 and collector 12 form a heat receiving part of a vapor generator. Hence, the distributor 14 and collector 12 are connected via pipes (not shown) which extend through the pressure vessel 1 to other parts of the vapor generator (not shown).

When the gasification plant is in operation, gases at a temperature of about 1400° C. which contain soot and slag particles flow from the reactor (not shown) through the lined pipe 31 and neck 7 into the insert 3 to be cooled therein. This cooling occurs by gas radiation onto the cooled wall of the insert 3 to a temperature of approximately 1,000° C. Near the bottom end of the insert 3, the gas flow is deflected outwardly through the peripheral openings and the bulk of the soot and slag particles dropping into the funnel 23 for removal therefrom by the continuously inflowing water. The gas which rises through the annular chamber 11 between the insert 3 and jacket 5 then experiences further cooling to approximately 400° C. before leaving the chamber 11 through the exhaust passage 43. Further cooling of the gas which is relatively easy may be obtained in subsequent heat exchangers wherein secondary sides are preferably also parts of the vapor generator.

As indicated in FIG. 1, the insert 3 and jacket 5 are suspended by hangers 16, 17, respectively which connect to the ribs between the tubes 6. The hangers 16 can be interconnected in gas tight manner from near the top outer edge of the insert 3 as far as the substantially horizontal sealingly interconnected tubes of the jacket 5 so that the fall chamber 10 and annular chamber 11 are completely isolated from the space outside the jacket 5. For convenience, a communicating orifice may be disposed near the top of the annular chamber 11 between the chamber 11 and the outer space about the jacket 5 so that there is also some pressure compensation via the jacket wall. In this way, the jacket 5 cannot be stressed by severe pressures.

Referring to FIG. 2, the insert 3 and the jacket 5 may be circumferentially offset from one another by an angle $\gamma = 360°/2n$. As indicated, the corners 50 of the insert 3 are offset from the corners 51 of the jacket 5 by an angle of 30°. As a result, six widened spaces 52 are distributed over the periphery of the chamber 11 to facilitate servicing of the pipe walls forming the insert 3 and the jacket 5. Similar widened spaces 53 are also located between the jacket 5 and the cylindrical wall of the pressure vessel 1. Access to the widened spaces 52, 53 may be made either by way of manholes (not shown) in the pressure vessel 1 and jacket 5 and/or by way of existing pressure vessel connections 34, 35, 43.

Of note, it is very important for the heat exchanger surfaces of hot gas coolers for coal gasification plants to be of compact construction since the hot gases which have to be cooled are at a relatively high positive pressure of, for example 4 MPa (equal to approximately 40 atmosphers absolute). Thus, the pressure vessel must have relatively thick walls.

The invention thus provides a cooler of compact construction which can be readily utilized with a coal gasification plant for cooling hot gases exhausting therefrom.

What is claimed is:

1. A hot gas cooler for a coal gasification plant comprising a pressure vessel having a vertically disposed casing with an inlet spigot at an upper end for receiving an exit of a reaction vessel;

an insert of polygonal cross-section of n-sides in said pressure vessel including a plurality of pipes for conducting cooling medium therethrough, said pipes being in secured relation to each other to define a fall chamber for conducting a hot gas therethrough, said insert having an inlet to said fall chamber at an upper end in sealed relation to said inlet spigot to receive a flow of hot gas, an outlet from said fall chamber at a lower end to discharge slag particles and a plurality of peripherally disposed openings to exhaust the hot gas flow from said fall chamber;

a jacket of polygonal cross-section of n-sides including a plurality of pipes for conducting a cooling medium therethrough, said pipes being secured together to form a gas-tight wall, said jacket being circumferentially offset from said inset by an angle equal to 360°/2n and spaced about said insert to define a first annular chamber therebetween communicating with said peripheral openings of said insert and sealed from said casing, said jacket being spaced from said casing to define a second annular chamber therebetween;

at least one gas exhaust passage connected to said jacket and communicating an upper end of said first annular chamber with the exterior of said casing for exhausting the cooled gas therethrough; and means for discharging slag from said outlet of said insert, said means including a funnel passing through said pressure vessel.

2. A cooler as set forth in claim 1 wherein said insert defines a part of a heated pressure system of a vapor generator.

3. A cooler as set forth in claim 1 wherein said insert is coaxial of said casing.

4. A cooler as set forth in claim 1 wherein said pipes of said insert and said jacket are connected in parallel between a common distributor and a common collector.

5. A cooler as set forth in claim 1 wherein said funnel is double-walled to receive cooling water in a space between said walls thereof.

6. A cooler as set forth in claim 1 wherein said funnel is secured to said insert and said jacket in seal tight relation.

* * * * *

UNITED STATES PATENT AND TRADEMARK OFFICE

CERTIFICATE OF CORRECTION

PATENT NO. : 4,395,268

DATED : July 26, 1983

INVENTOR(S) : Jaroslav Zabelka

It is certified that error appears in the above-identified patent and that said Letters Patent is hereby corrected as shown below:

On the title page Insert

-- (73) Assignee: Sulzer Brothers Limited,
Winterthur, Switzerland --.

Signed and Sealed this

*Sixth* Day of *December 1983*

[SEAL]

*Attest:*

GERALD J. MOSSINGHOFF

*Attesting Officer*

*Commissioner of Patents and Trademarks*